US011795975B2

(12) United States Patent
Mosiewicz

(10) Patent No.: US 11,795,975 B2
(45) Date of Patent: Oct. 24, 2023

(54) LOW NOISE AND HIGH EFFICIENCY BLADE FOR AXIAL FANS AND ROTORS AND AXIAL FAN OR ROTOR COMPRISING SAID BLADE

(71) Applicant: R.E.M. HOLDING S.R.L., Milan (IT)

(72) Inventor: Roberto Eduardo Mosiewicz, Arona (IT)

(73) Assignee: R.E.M. HOLDING S.R.L., Milan (IT)

( * ) Notice: Subject to any disclaimer, the term of this patent is extended or adjusted under 35 U.S.C. 154(b) by 697 days.

(21) Appl. No.: 15/776,024

(22) PCT Filed: Nov. 16, 2016

(86) PCT No.: PCT/EP2016/077874
§ 371 (c)(1),
(2) Date: May 14, 2018

(87) PCT Pub. No.: WO2017/085134
PCT Pub. Date: Jun. 26, 2017

(65) Prior Publication Data

US 2020/0049166 A1 Feb. 13, 2020

(30) Foreign Application Priority Data

Nov. 16, 2015 (WO) ..... PCT/EP2015/076713

(51) Int. Cl.
*F04D 29/66* (2006.01)
*F04D 29/36* (2006.01)
*F04D 29/38* (2006.01)

(52) U.S. Cl.
CPC ..... *F04D 29/666* (2013.01); *F04D 29/36* (2013.01); *F04D 29/386* (2013.01);
(Continued)

(58) Field of Classification Search
CPC ..... F04D 29/36; F04D 29/384; F04D 29/386; F04D 29/666
See application file for complete search history.

(56) References Cited

U.S. PATENT DOCUMENTS 2,582,559 A * 1/1952 Pearson ..... B63H 3/04 416/167
3,972,646 A * 8/1976 Brown ..... B63H 1/26 416/228

(Continued)

FOREIGN PATENT DOCUMENTS

EP 0955469 A2 11/1999
WO 2007089081 A1 8/2007

OTHER PUBLICATIONS

Communication under Rule 71(3) EPC dated Jan. 26, 2022, in connection with corresponding European Application No. 16825703.8; 5 pages.

*Primary Examiner* — Woody A Lee, Jr.
*Assistant Examiner* — Cameron A Corday
(74) *Attorney, Agent, or Firm* — Maier & Maier, PLLC

(57) ABSTRACT

Today the low noise blades and especially the super low noise blades for large diameter axial fans which are employed in the big cooling machines and cooling plants are so costly and are requiring so many extra costs on the other related equipment, that the noise pollution abatement can increase the whole cooling apparatus cost by up to a 35%. This invention, provides a new technology to make low noise fans able to transform any common blade into a low noise or very low noise at very low cost, preserving the same high efficiency and tip speed, as opposite to all the other low noise blades at actual status of art. As the fans for the big cooling apparatus are generally their main noise source, this
(Continued)

invention will offer the opportunity to dramatically reduce the noise pollution produced by big cooling machines and cooling plants.

14 Claims, 13 Drawing Sheets

(52) U.S. Cl.
CPC ..... *F05B 2240/30* (2013.01); *F05B 2250/71* (2013.01); *F05B 2260/96* (2013.01)

(56) References Cited

U.S. PATENT DOCUMENTS

| | | | | |
|---|---|---|---|---|
| 4,221,541 | A | 9/1980 | Bianchi | |
| 4,893,990 | A | 1/1990 | Tomohiro et al. | |
| 5,584,661 | A * | 12/1996 | Brooks | B64C 27/467 416/238 |
| 6,024,536 | A | 2/2000 | Tsubakida et al. | |
| 6,334,705 | B1 * | 1/2002 | Weetman | B01F 3/04531 366/330.1 |
| 6,648,936 | B2 * | 11/2003 | Higashino | B01D 45/14 416/178 |
| 7,600,975 | B2 * | 10/2009 | Lotrionte | F03B 3/04 416/223 R |
| 8,851,851 | B2 | 10/2014 | Moore | |
| 9,845,683 | B2 * | 12/2017 | Lamb, Jr. | F01D 5/14 |
| 2011/0240268 | A1 | 10/2011 | Moore | |
| 2012/0003097 | A1 | 1/2012 | Cho et al. | |
| 2012/0128501 | A1 * | 5/2012 | Hoofard | F03D 13/10 416/241 R |

* cited by examiner

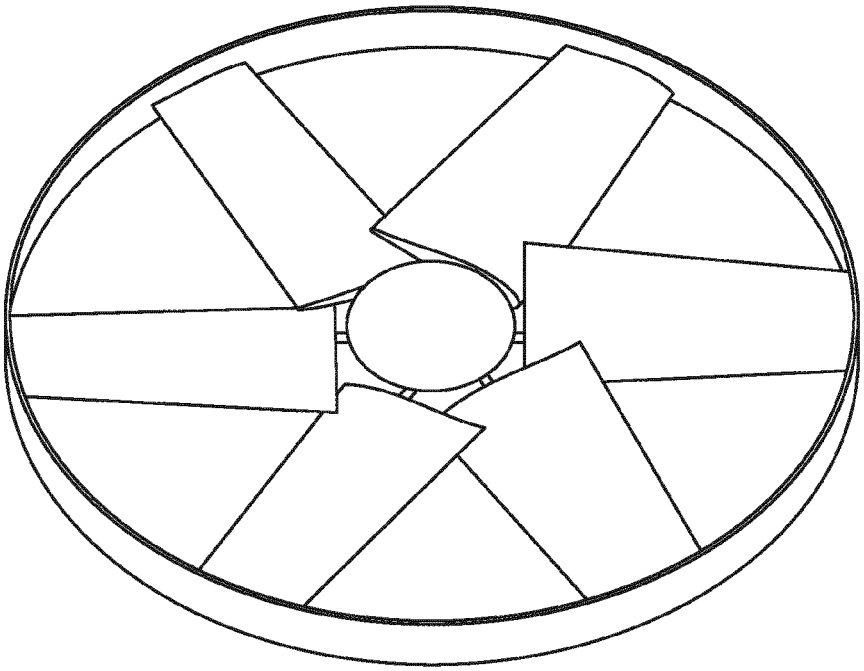
Fig. 1 — PRIOR ART
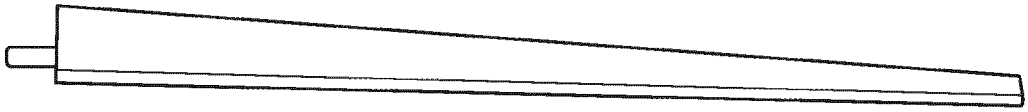
Fig. 2a — PRIOR ART

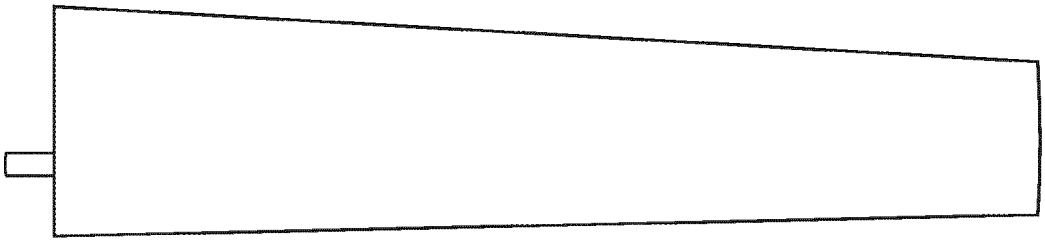
Fig. 2b — PRIOR ART
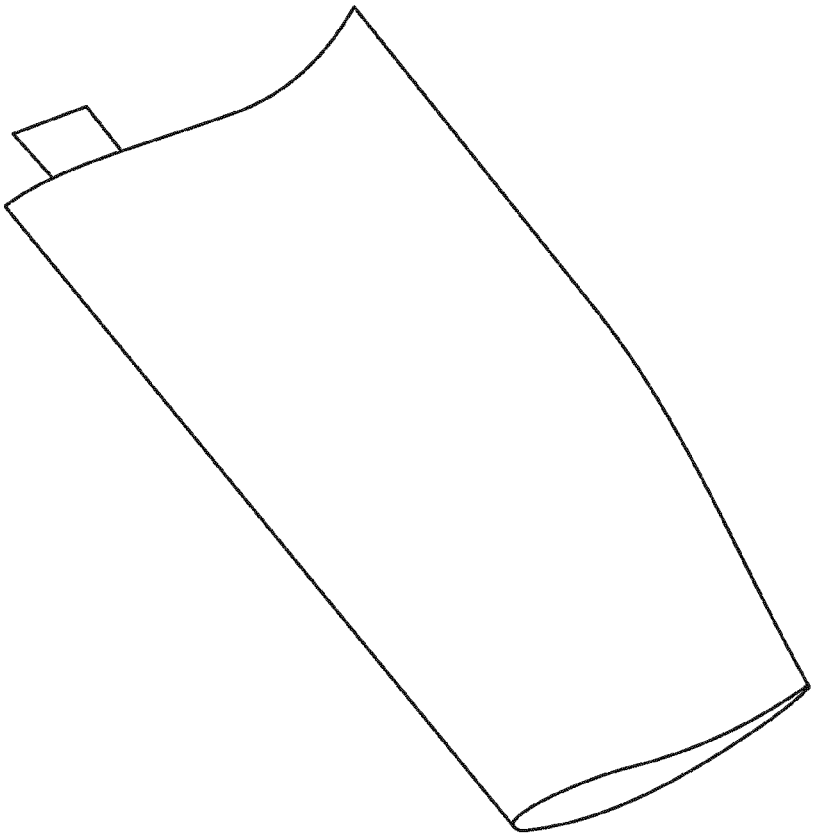
Fig. 2c — PRIOR ART

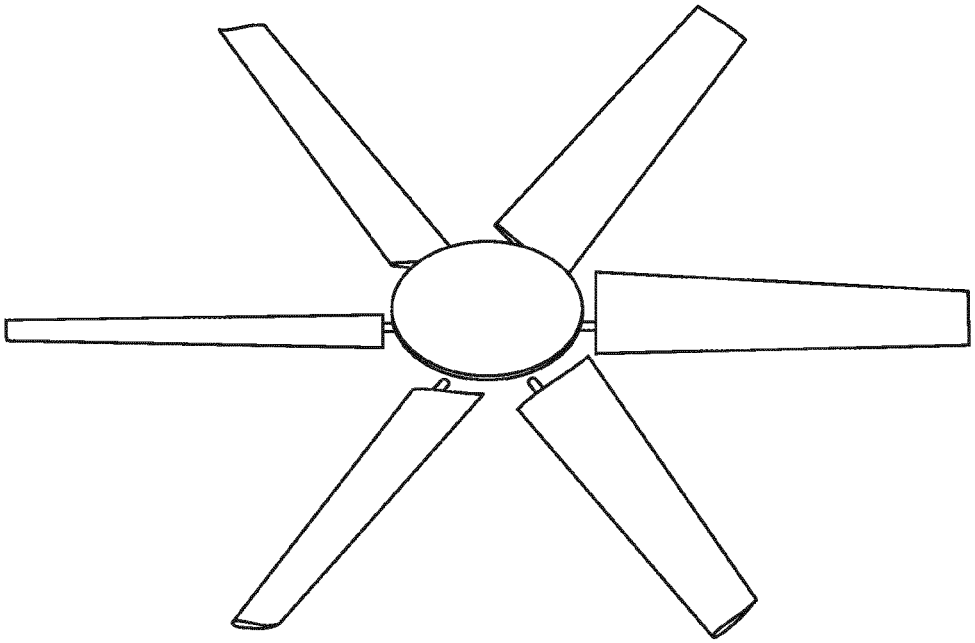
Fig. 3a —— PRIOR ART
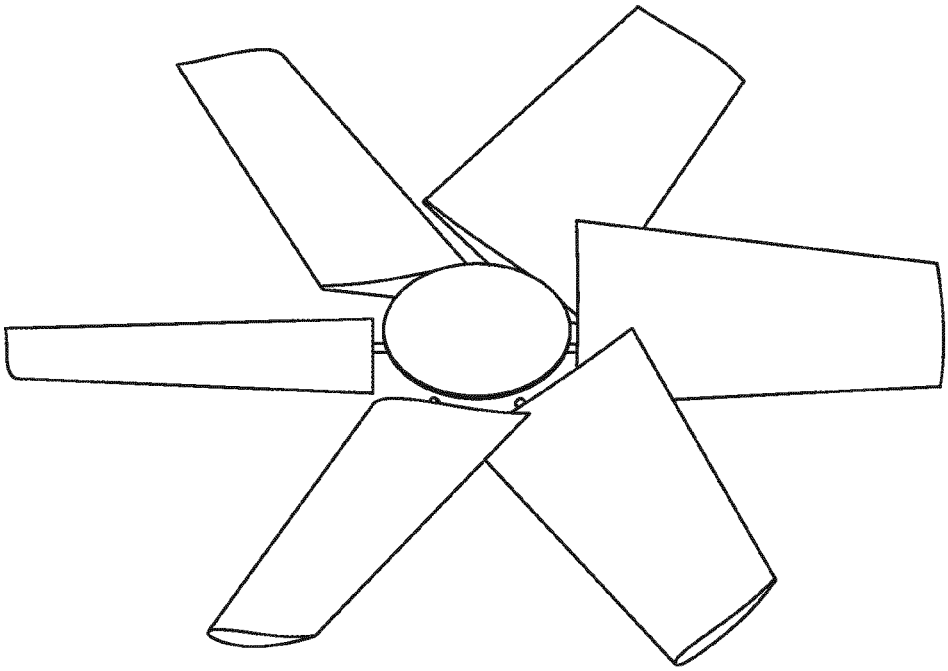
Fig. 3b —— PRIOR ART

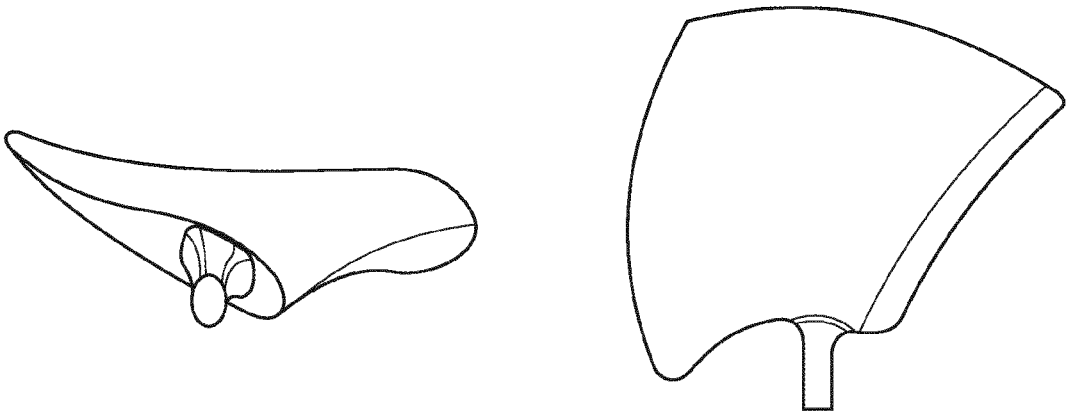
Fig. 4a — PRIOR ART
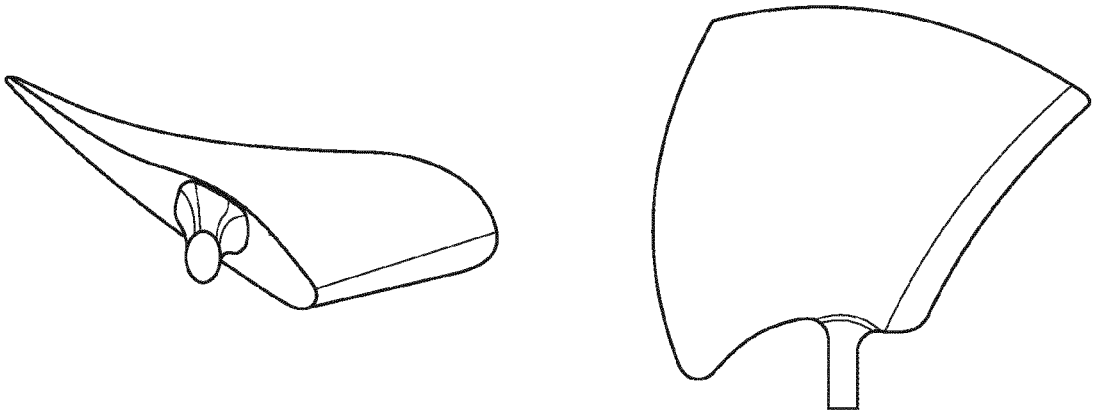
Fig. 4b — PRIOR ART

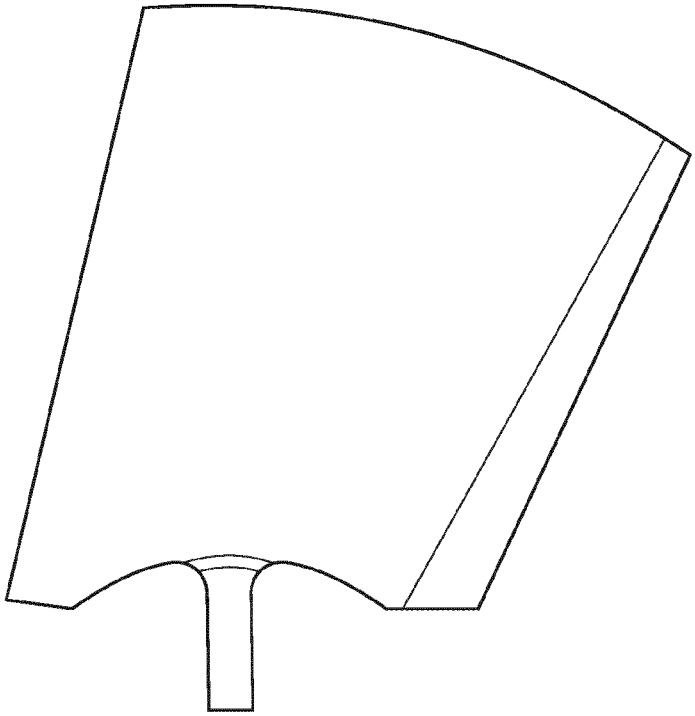
Fig. 4c — PRIOR ART
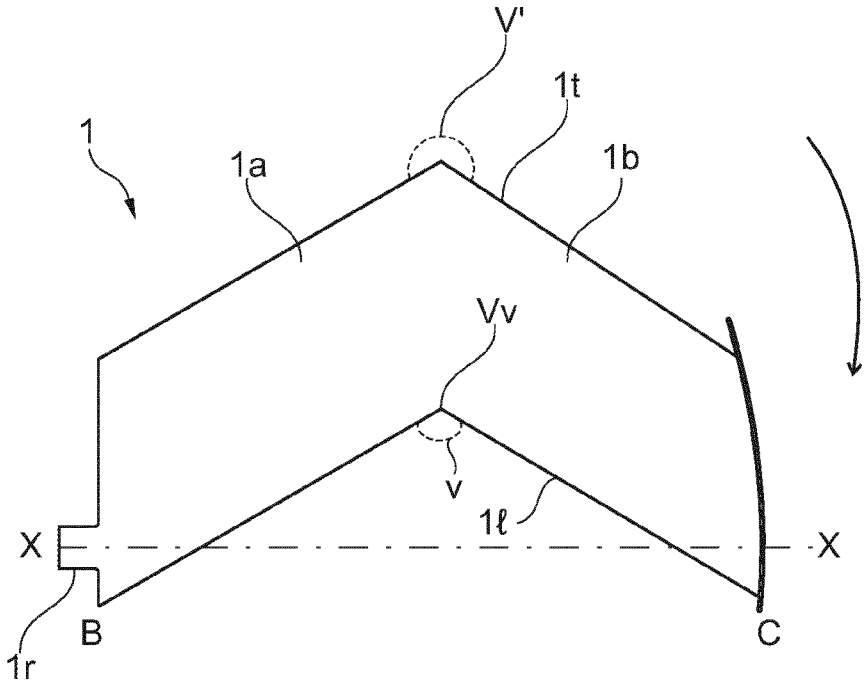
Fig. 5

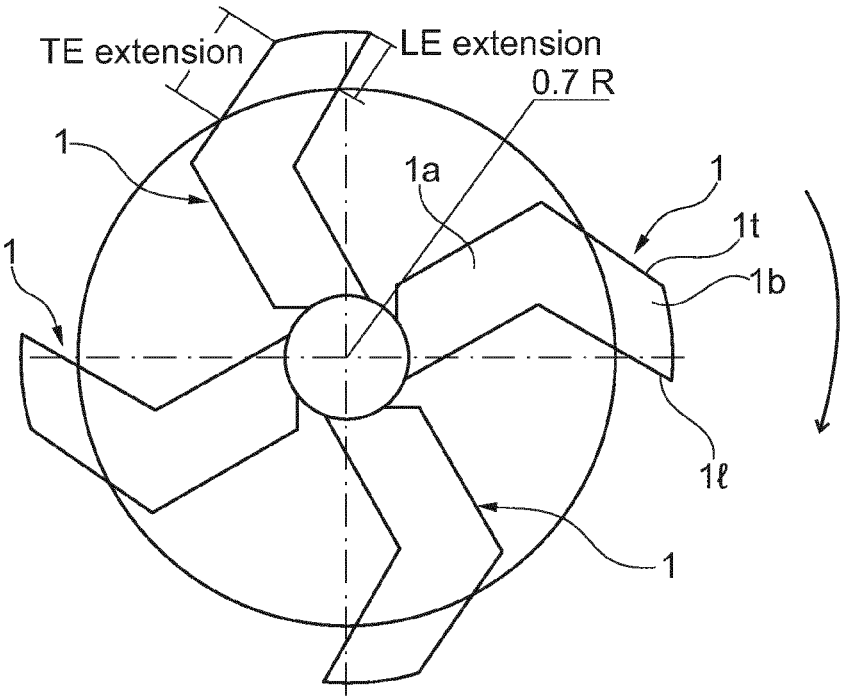
Fig. 6
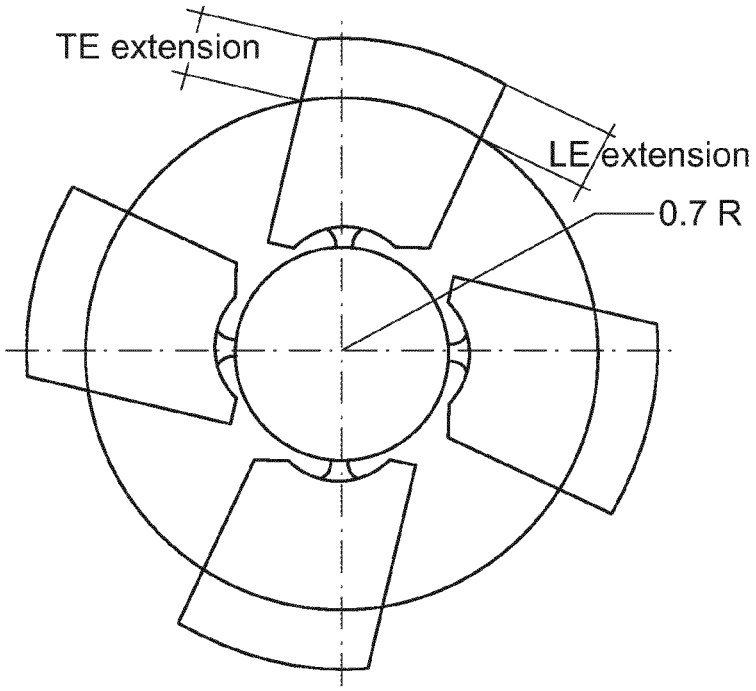
Fig. 7a — PRIOR ART

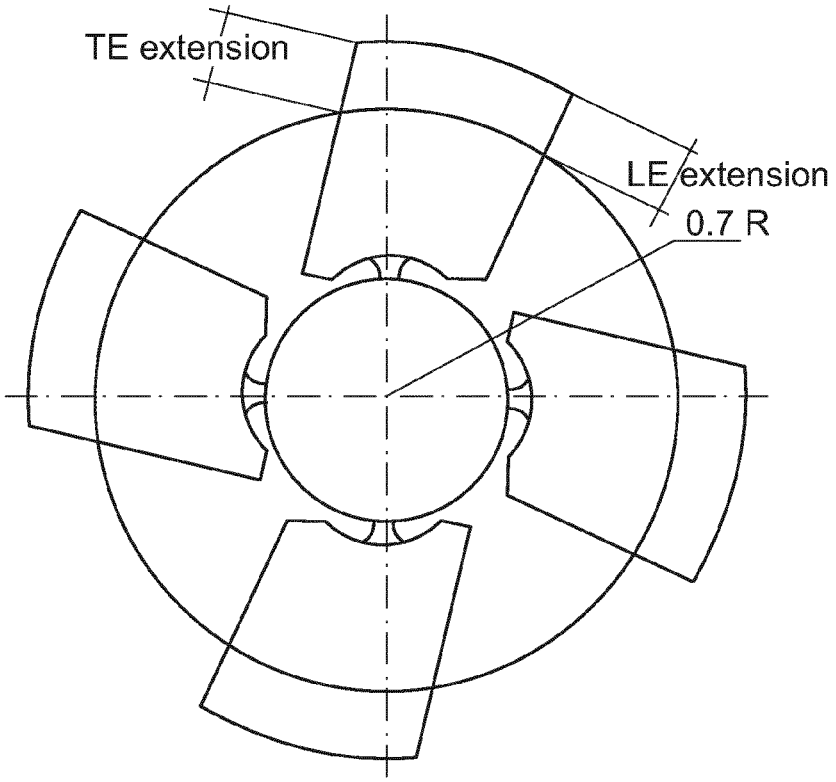
Fig. 7b — PRIOR ART
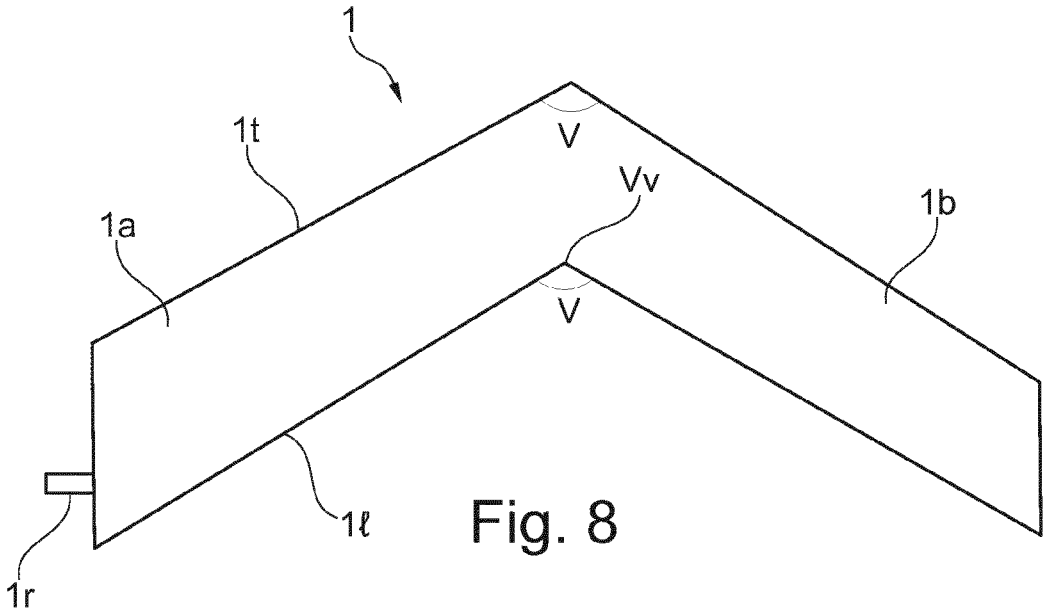
Fig. 8

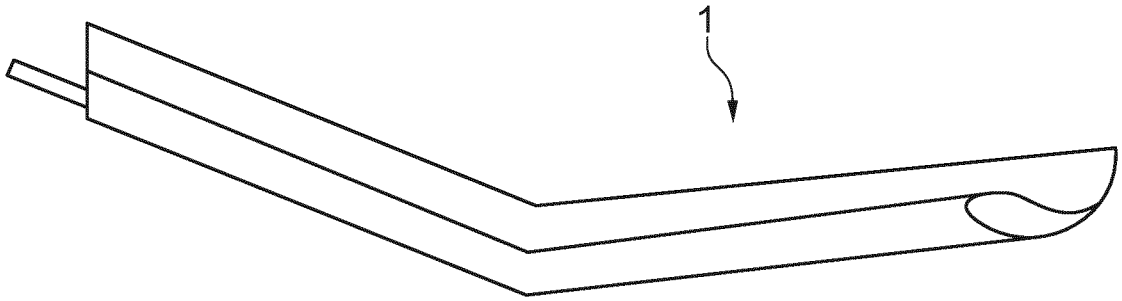
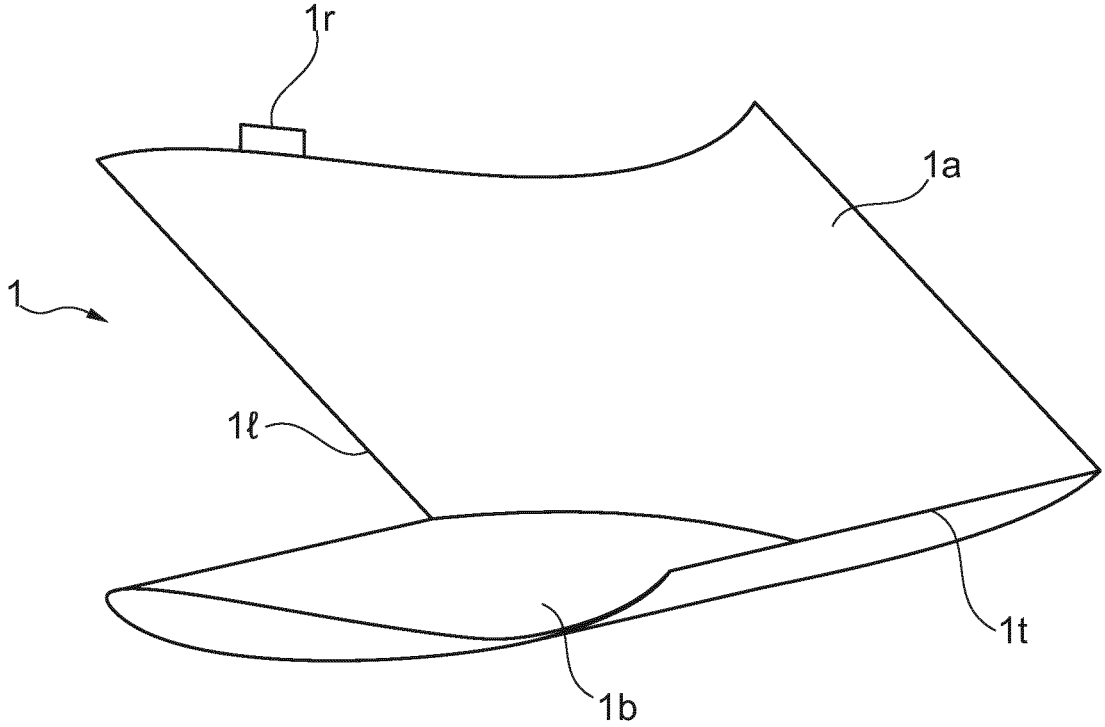
Fig. 10

LOW NOISE AND HIGH EFFICIENCY BLADE FOR AXIAL FANS AND ROTORS AND AXIAL FAN OR ROTOR COMPRISING SAID BLADE

FIELD OF THE INVENTION

The present invention relates to a low noise and high efficiency blade for axial fans; in particular, the present invention relates to a low noise and high efficiency blade for industrial axial fans, and more particularly for large diameter axial fans.

The present invention further relates to an axial fan, particularly a large diameter industrial axial fan, equipped with a low noise and high efficiency blade.

PRIOR ART

Axial fans as used in commercial air cooled apparatuses have to be distinguished in two main groups comprising small size cooling fans and big size cooling fans, respectively.

In fact, the size of a cooling fan can vary from few millimeters (as in the case of a fan of the kind used to cool electronic devices), to few decimeters (as in the case of a fan used to cool an automotive motor), and even up to the 20 meters of diameter of a fan used in an ACC or a water cooling tower plant.

The boundary limit of the two groups of course cannot be rigidly fixed but it is usually located, among those skilled in the art, approximately at a fan diameter of about 900 mm, meaning that fans with a diameter less than 900 mm belong to the first group, whilst fans with a diameter more than 900 mm belong to the second group.

The technical characteristics of a fan strongly depend on its size (diameter) and differ depending thereon whether the fan belongs to the first group or the second group, essentially due to the fact that the performances to be provided by fans belonging to the two groups are different.

The above means that large diameter axial fans have technical characteristics which are deeply different from those of small size fans, irrespective of the fact that even fans with different dimensions (diameter) are provided for the same purpose, namely moving the air in order to cool apparatuses and/or equipments or the like.

The main reason why the technical characteristics change so dramatically with the increasing of the fan size relates to the fact that the forces, and powers, acting on the fan depend on its diameter. As an example, the absorbed power of a few mm size fan is a small fraction of kW whereas a very large fan can absorb a few hundred kW.

In the same way, during the operation, the forces acting on the blades of a large diameter fan, are very high so that the structural design of large size fans (heavily loaded during rotation) becomes very complicated, essentially due to the fact that complicated shapes which, in the case of small fans would allow to reduce noise and improve efficiency level, may not be taken into consideration in the case of large fans.

Moreover, the efficiency of a fan must be considered as well, due to the large amounts of power consumption involved; in fact, in the case of large fans, few percentage points of higher efficiency may result into tenths of kilowatts being saved.

It has moreover to be noted that, in general terms, small fans, in view of both their small size and their technical characteristics, can usually be realized in one piece casting, and can include a peripheral ring binding all the blades to add strength to the fan.

A fan according to the prior art comprising a peripheral ring is depicted in FIG. 1 as an example of a fan with improved stability, but wherein even the efficiency is improved by the peripheral ring (which help to prevent the backflow at the tip of the blades).

It is well known among those skilled in the art that large fans may usually not be provided with a peripheral ring of the kind depicted in FIG. 1, essentially due to structural reasons. Moreover, even assuming that it would be technically possible to realize said peripheral ring also for a large fan, the provision of the ring would not match with a further need arising in case of large fans, namely that of adjusting the pitch in view of the circumstances.

In fact, most of the cooling apparatuses served by said fans are custom tailored and the fan operative conditions are very variable, meaning that, in order to satisfy said operative conditions a pitch adjustment is mandatory. Secondly, it is important to have the possibility to adjust the pitch because customers require to have the possibility to adjust the pitch on site.

However, an adjustable pitch implies an open space between the blade tip and the fan ring, but the mandatory open space negatively affects the fan efficiency.

The dimension of this space has been limited by the international standard to 3 to 5 thousandths of the fan diameter; however, the above mentioned standard can be met, in the case of adjustable pitch, only when the blades are oriented at a predefined pitch angle whilst, for all the other pitch angles (other than the predefined one), the standard is met only in the area where the pitch angle adjustment axis is located; accordingly, by increasing or decreasing the pitch angle it cannot be avoided that the leading and trailing edge are moved away from fan ring, mainly in function of the blade chord, thus increasing the backflow.

Moreover, as to the need of keeping the noise at low values in the field of large fans, further information and definitions are provided below for the purpose of both better clarifying the state of the prior art and better appreciating the present invention.

Generally speaking it is possible to divide the large fans requirements according to the noise level requested in three categories:

First noise level: there are no special requirements as to the noise level. The fans have rather narrow chord and are operating at the maximum tip speed accepted by the standards, which is about 60 m/s. In general this is the condition allowing the fans to provide their best efficiency at the lowest costs. Today there are three main typical blades commonly used in large fans in the market and they are depicted in FIGS. 2*a*, 2*b* and 2*c*. In the case of these three blades, high efficiency is obtained by using an aerodynamically efficient profile and having a uniform air velocity over the entire radius. The uniform air distribution is obtained by each blade type in a different way: the blade of FIG. 2*a* is twisted, the blade of FIG. 2*b* is tapered, the blade of FIG. 2*c* comprises on the profile a trimmed flap so that the blade finally results to be both twisted and tapered.

Second noise level: when medium low noise requirements have to be met, meaning that the noise level must be reduced by around 5 dB(A). According to the known solutions, this is obtained by extending the chord width in order to decrease and distribute the forces acting on the blade surface and to compensate the loss of performance due to speed reduction to 45 m/s. A typical chord increase ratio could be 2.5 times with respect to the a first noise level fan. It is however easy to imagine that the costs are strongly affected (increased) by the need of increasing the chord width. But the cost increase is not the only negative effect. In fact, also the extension as such of the chord width all along the blade span has some detrimental effects on the blade aerodynamic performance: in fact, as it is well known to a technician skilled in aerodynamics, the increasing of the ratio width/length of the blade, according to the wing theory, reduces the aerodynamic efficiency.

A further negative effect of this condition relates to the fact that the ratio total-chord-at-tip/circumference, called solidity, assumes values that negatively affects the efficiency of the fan. Additionally, it has to be reminded that the fans as referred to herewith belong to the large fans category that are required to have adjustable pitch angle, meaning that the same blade can be used in situations where the pitch angle is very large, typical for low speed, wherein however the big tip clearance on leading and trailing edge reduces the efficiency and increases the noise.

In a 10 m fan, increasing the chord from 0.6 m (typical for a first noise level fan) to 1.4 m (typical for a second noise level fan), would mean that the tip clearance at both the leading and trailing edge would increase up to 5.5 times, meaning that this solution therefore would have as a consequence a big cost increase and an important efficiency loss. Furthermore, there would be also a big cost increase of the power transmission equipment due to the higher speed ratio increase, along with a cost increase of the motor because the lower efficiency requires a higher power motor.

In the FIGS. 3*a* and 3*b* is possible to see in a real case how different is the solidity on the fans of first and second noise level.

Third noise level: generally called in the field super low noise, requires a further reduction of about 4 dB(A) of the noise value with respect to low noise fans. According to the methods used today to obtain this noise reduction, the tip speed is further reduced, the tip chord is increased and the blades are swept forward in the direction of fan rotation in order to decrease the local pressure fluctuations generated by the impingement of the flow, to mistune the sound emission and to decrease the accumulation of the boundary layer over there.

There are essentially three known methods to realize said forward sweeping of the blade: sweeping the leading edge in the space as depicted in FIG. 4*a*, sweeping the leading edge in the plane as depicted in FIG. 4*b*, sweeping according to a line as depicted in FIG. 4*c* (and further disclosed in U.S. Pat. No. 8,851,851 B2).

As depicted, all these types of blades clearly have a very large chord at the tip and, especially the blade of FIG. 4*a*.

All these prior art systems, but in particular the first of them, have a very complicated shape. As already disclosed above, the large tip chord brings to a further efficiency loss compared to the blades of the second noise level. But there is even another important reason of inefficiency: the very large shape of the blade does not allow efficient aerodynamic section distribution because their size decreases toward the hub and the high increase in twist at root does not allow to compensate what has been lost due to chord decrease.

In view of the above it may be stated that all the systems and methods today available on the market to reduce the noise of large fans have a very important drawback, namely a very large amount of energy loss and very high costs of the whole machine or plant, even more than 30% than a second noise level fan.

SUMMARY OF THE INVENTION

It is therefore the main aim of the present invention that of providing a blade, in particular for super low noise large diameter axial fans which allows, to overcome the drawback left unsolved by the prior art.

Within this aim, it is an object of the present invention to provide a blade, in particular for super low noise fans and rotors which still has high aerodynamic efficiency when compared with super low noise fans of the known type, in the same functioning conditions.

It is also an object of the present invention to provide a blade, in particular for super low noise large diameter axial fans or rotors which has reduced manufacturing costs with respect to the blades known for the same applications.

The present invention is therefore based on the main consideration that the drawbacks affecting both blades and fans according to the prior art can be efficiently overcome or at least drastically reduced by providing a blade which, when fixed to the rotor at a zero pitch-angle, has a V-shaped projection on a plane parallel to the rotation plane.

Moreover, according to a further consideration, the V-shaped blade is preferably obtained by joining a first, inner, blade part with a second, outer blade part, having either approximately the same length or even different lengths (depending on the embodiment), so as to form an obtuse angle on the leading edge of the blade.

In view of both the above considerations and the drawbacks affecting blades and fans according to the prior art, disclosed in the following is a blade for low noise and or high efficiency axial fans, said blade comprising a front edge and a rear edge, the front edge being the leading edge of the blade facing the direction of rotation of the fan in an operative condition and said rear edge being the trailing edge of the blade, said blade comprising a first blade part and a second blade part, said first and second blade part forming on said leading edge an obtuse angle V so that the projection of the blade profile on a plane parallel to the rotational plane of the fan, is a V-shaped profile.

As disclosed, the same angle V may be present at said trailing edge and at said leading edge of said blade, at the joint of said first part with said second part.

Still as disclosed, with reference to the line X joining the points where a pitch adjustment axis is crossing the blade root section and the blade tip section, the vertex on the leading side may lie on one side and the root and the tip leading edges on the other side, or the vertex V may lie on the one side along with the root and the tip leading edges.

Still as disclosed, said first and said second blade parts have approximately the same length or different length depending on the needs and/or circumstances.

Still as disclosed, said obtuse angle V may be comprised between 90° and 170°, in particular between 100° and 120°.

As disclosed, at the portion of the blade where said first part and said second part are joint, a dihedral angle of about 195° is formed between the suction surfaces of first and the second part in the vertical plane.

Still as disclosed, the first, inner part is obtained starting by a rectilinear blade by rotating a part of the blade profile backwards counterclockwise, around the vertical axis passing where the pitch adjustment axis is crossing the blade root section, and the second, outer part is obtained by rotating a part of the blade profile backwards clockwise around the vertical axis passing where the pitch adjustment axis is crossing the blade tip section.

As disclosed, the blade or its airfoil part may be a one piece blade, made of casting aluminum or steel or plastic or any other suitable material.

As disclosed, said first blade part and second blade part may form on said leading edge a rounded angle.

Still as disclosed, said first blade part and second blade part may form on said trailing edge a rounded angle.

As disclosed, one or both of said blade part and second blade part may have slightly curved leading edges.

Still as disclosed, said first blade part and second blade part may have slightly curved trailing edges.

Further disclosed is a super low noise industrial axial fan, comprising the blade according to one or more of the above embodiments.

In particular, according to a first embodiment of the present invention there is provided a blade according to claim 1.

Further embodiments of the present invention are defined by the dependent claims.

BRIEF DESCRIPTION OF THE DRAWINGS

In the following, description will be given of the embodiments of the present invention as depicted in the drawings wherein, however, the present invention is not limited to the embodiments as depicted in the drawings and disclosed below.

In the drawings:

FIGS. 1, 2*a*, 2*b*, 2*c*, 3*a*, 3*b*, 4*a*, 4*b*, 4*c*, 7*a*, 7*b*, show different examples of blade assemblies for axial fans according to the prior art. More in details:

In FIG. 1 there is depicted a perspective view of a small diameter axial fan according to the prior art provided with a ring on its periphery;

In each of FIGS. 2*a*, 2*b*, 2*c* there is depicted a blade according to the prior art of the kind commonly used in known large fans: in FIG. 2*a* there is depicted a twisted blade, in FIG. 2*b* there is depicted a tapered blade, in FIG. 2*c* there is depicted a trimmed blade;

In FIG. 3*a* there is depicted an example of first noise level large diameter (10 meters) fan according to the prior art;

In FIG. 3*b* there is depicted an example of second noise level large diameter (10 meters) fan according to the prior art;

In FIGS. 4*a*, 4*b* and 4*c* there are depicted corresponding examples of blades of super low noise axial fans according to the prior art. More in details:

In FIG. 4*a* there is depicted a blade having a leading edge both curved and swept into the space;

In FIG. 4*b* there is depicted a blade having a leading edge swept in a plane;

In FIG. 4*c* there is depicted a blade having a leading edge swept according to a straight line;

In FIG. 5 there is depicted a top (plan) view of a blade according to a first embodiment of the present invention;

In FIG. 6 there is depicted a schematic top view of a super low noise large diameter axial fan equipped with blades according to an embodiment of the present invention;

In FIG. 7*a* there is depicted an example of a super low noise axial fan according to the prior art, having trailing and leading edge extension at outer third of the radius;

In FIG. 7*b* there is depicted an example of super low noise axial fan according to the prior art, having trailing and leading edge extension at outer third of the radius;

In FIG. 8 there is depicted a top (plane) view of a blade according to a second embodiment of the present invention wherein the blade is a tapered and twisted blade;

In FIG. 10 there is depicted a blade according to the present invention, the dihedral angle being visible;

DETAILED DESCRIPTION OF THE INVENTION

Figure 8A:
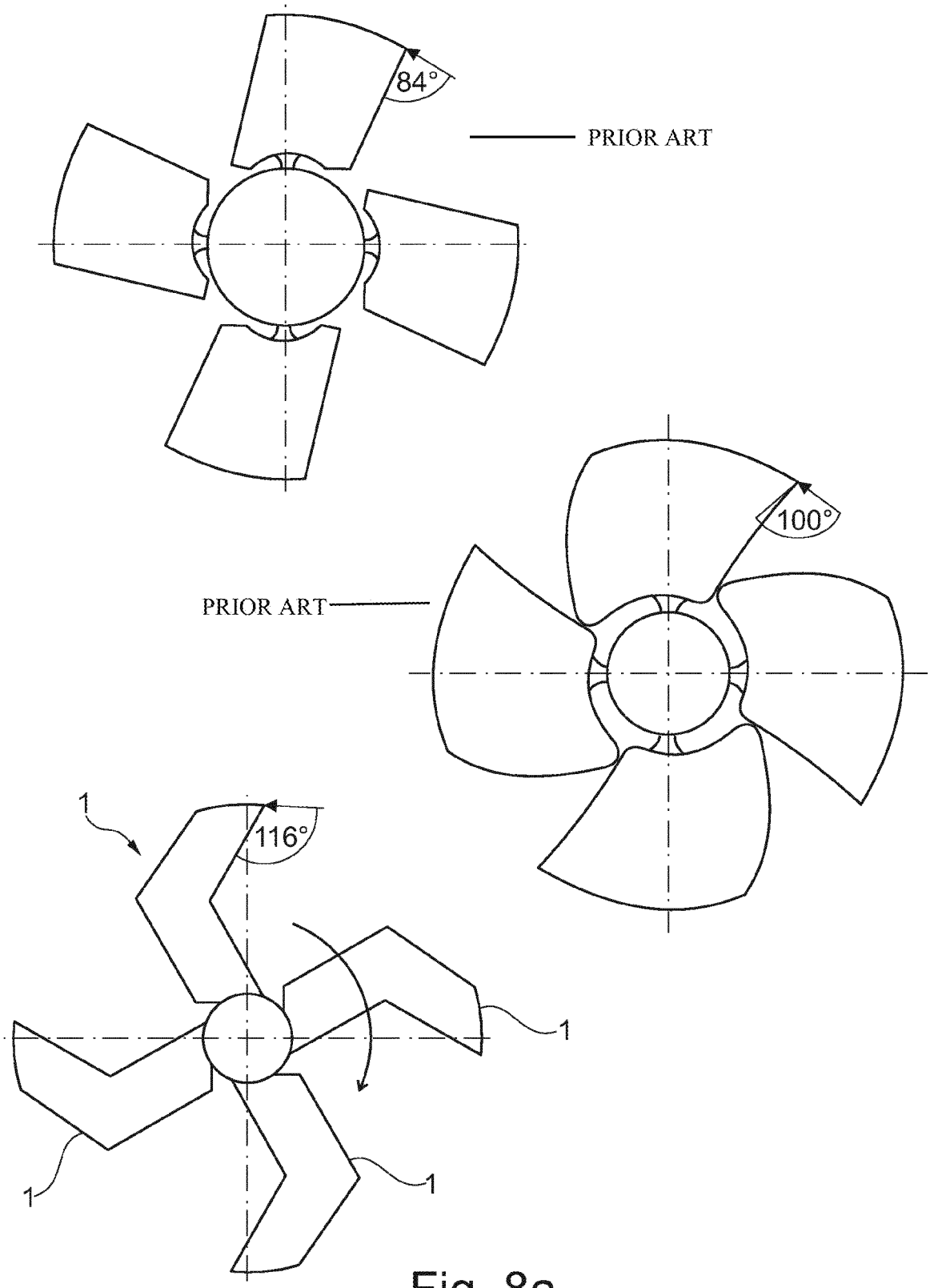
In FIG. 8*a* there are compared the angles at tip leading edge and the air relative velocity of blades according to the prior art and an embodiment of the present invention, respectively.

It will become apparent, in view of the following description, that the main task of the present invention is to provide a blade, in particular for large diameter super low noise industrial axial fans, this being the reason why, in the following, description will be given of a blade for super low noise large diameter industrial axial fans which can be also used with industrial fan of the type already known in the art to obtain noise reduction while preserving at least the same aerodynamic efficiency.

In FIG. 5, the blade according to the embodiment of the present invention as depicted therein is identified by the reference numeral 1. The blade 1 comprises in particular a root portion 1*r* provided for the purpose of fixing the blade 1 to an axial rotor (not depicted in FIG. 5); in particular, the blade may be fixed to the axial fan at different orientation angles (pitch angles) with respect to the axis X-X as identified by the dashed line in FIG. 5. The rotor is supposed to be rotated, during operation of the fan, in the clockwise direction as depicted by the arrow, the axis of rotation of the fan corresponding to the axis of rotation of the rotor. With respect to FIG. 5, the axis of rotation is perpendicular to plane of the figure; the smallest pitch angle is the angle at which the projection of the blade on a plane perpendicular to the axis of rotation occupies the largest area or surface. Pitch angles of larger amounts result in the projections of the blade on the plane perpendicular to the axis of rotation (also referred to, in the following, as the "plane of rotation) occupying corresponding smaller areas or surfaces. As depicted, with the blade 1 oriented at the smallest pitch angle, in particular at zero pitch angle, the projection of the blade on the rotation plane, is such that a V shape is formed along the span of the blade (see FIG. 5). In particular, the blade 1 comprises a first, inner, portion 1*a* close to the rotational axis and extending from the root portion 1*r*, along with a second, outer, portion 1*b*, having approximately the same length of the first portion 1*a*, and extending from the first portion 1*a*. With respect to the axis X-X, the first portion 1*a* extends along a first direction (forming an angle with the axis X-X), whilst, still with respect to the axis X-X, the second portion 1*b* extends along a second direction other than the first direction (forming an angle with the axis X-X other than the angle formed by the first portion 1*a*).

Moreover, with respect to the direction of rotation of the blade 1 (identified by the arrow in FIG. 5), in the blade 1 two edges can be identified, namely the leading edge 1*l* impinging against the air during rotation of the blade 1), and the trailing edge 1*t* (opposite to the leading edge 1I).

Still as depicted, the first portion 1*a* and the second portion 1*b* are oriented one with respect to the other so that an obtuse angle V (more than 90° and less than 180° is defined by the leading edge 1I, whilst an a bigger angle (more than 180°) is defined by the trailing edge 1*t*.

Still with reference to the axis X-X which, as depicted, crosses both the blade portion 1*a* and the blade portion 1*b*, the vertex Vv of the angle V defined by the leading edge 1*l* is located on one side of the axis X-X, whilst the opposite tips (points B and C) of the leading edge 1*l* are located on the opposite side.

The above disclosed feature is a unique, distinguishing feature of the blade according to the present invention and has been ideally obtained according to the following way: starting from a substantially rectilinear blade as depicted for instance in FIG. 3*a*, the inner part 1*a* is obtained by rotating (bending) the blade backwards with respect to the root portion 1*r* (counterclockwise with respect to FIG. 5), in particular around the vertical axis passing where the pitch adjustment axis X-X is crossing the blade root section 1*r*, whilst the outer part 1*b* is obtained by rotating (bending) the blade backwards with respect to the first portion 1*a* (clockwise with respect to FIG. 5), in particular around the vertical axis passing where the pitch adjustment axis X-X is crossing the blade tip section.

The blade 1 has a very particular behavior with respect to noise and efficiency. Carrying out an extensive test program on a 10 feet diameter axial flow fan equipped with blades of the kind disclosed above and depicted in FIG. 5, starting first with a V angle of 170° and decreasing same to 90°, the inventor discovered that, as a result of the reduction of the angle V the fan noise also decreased. In particular, with angles between 120° and 100° it is possible to obtain a noise reduction equal or better than that of noise levels 2 and 3 of the prior art low noise fans described ahead. But, and this is extraordinary, it has been discovered that the high efficiency of common blades belonging to noise level 1 can be maintained and in some cases increased, meaning that, according to the needs and/or circumstances, the present invention can even be used just to increase the fan efficiency.

A further improvement has been obtained with a blade as depicted in FIG. 10 wherein, at the joining section, the inner portion 1*a* and the outer portion 1*b* defines a dihedral angle of about 192°, meaning in particular that, in the projection of the leading edge 1*l* om a plane perpendicular to the rotation plane, the projections of the leading edges of the first portion 1*a* and the second portion 1*b* are oriented along different directions.

Figure 11:
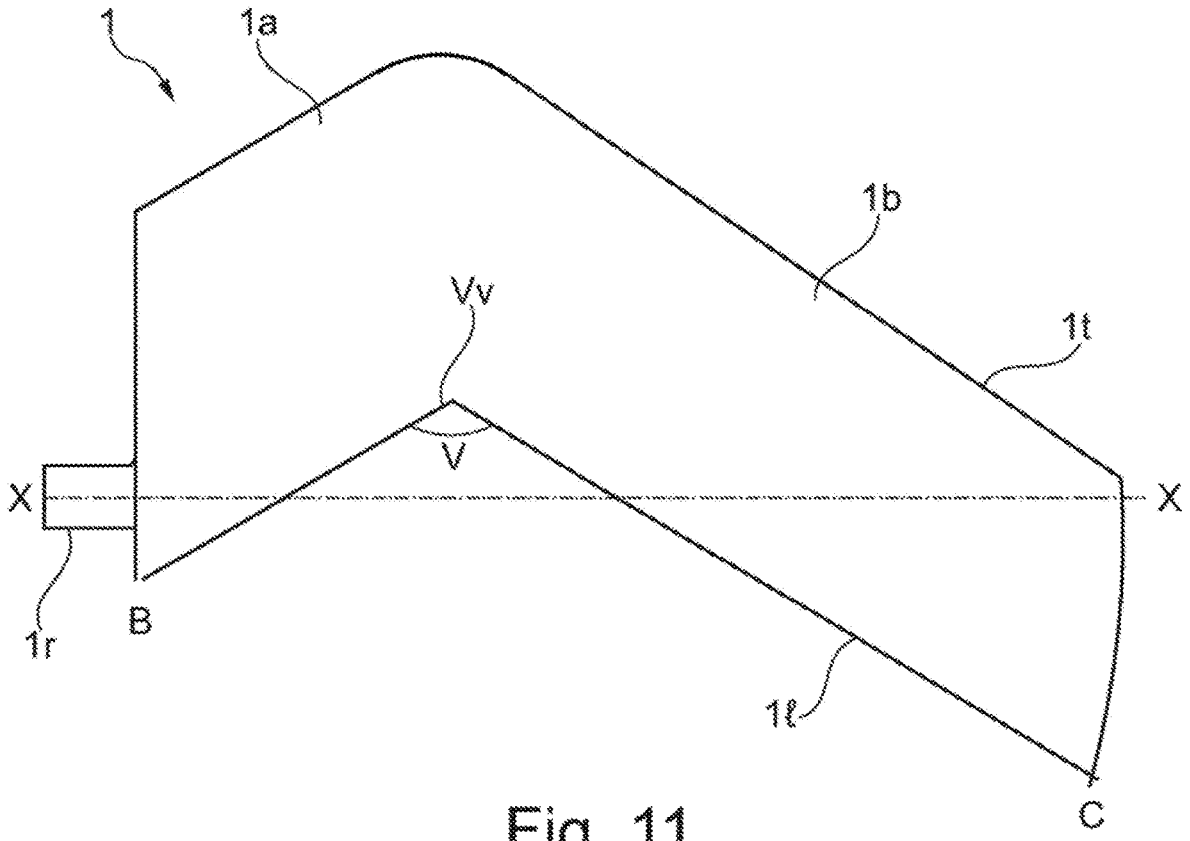
In FIG. 11 there is depicted a blade according to a further embodiment of the present invention.

Based on the above tests it has even been verified that the above disclosed design remains essentially advantageous, as compared with that of blades according to the prior art, even if the vertex Vv and/or the points B and C are shifted to positions other than those depicted in FIG. 5 as depicted, by way of example, in FIG. 11 (relating to a further embodiment of the blade 1 according to the present invention). As depicted in FIG. 11, the tip leading edge point C is forward translated with respect to the root leading edge point B.

Moreover, the above disclosed geometry (design) remains effective even if the size ratio between inner and outer portions is changed.

The above changes can be very helpful for the optimization of different types of blades and also because they are acting in a different way on noise and efficiency, therefore depending if noise improvement or efficiency improvement is preferred different solutions can be preferred.

The main reasons why the above disclosed, indeed quite extraordinary results can be obtained with a blade according to the present invention are related to the fact that the above disclosed geometry and/or design is affecting not just one but several among the noise generating and efficiency reducing factors. Some of these factors are mentioned herewith; however, there are additional factors helping to get these results which are not mentioned because it is not yet very clear how important they are.

Herewith explanation is essentially given of the main reason why the low noise levels are achieved and secondly why it was possible to preserve or improve the fan efficiency. Moreover, some more information are given as to additional advantages of the present invention such as, for instance, those related to the reduction of costs. With reference to FIGS. 6, 7*a* and 7*b* the outer portion of the blade according to the present invention (FIG. 6) will be compared in the following with that of a blade according to the prior art (FIGS. 7*a* and 7*b*) considering that, as it is well known, the outer portion of a blade is interested by over 70% of air volume, meaning that the outer portion is the most important part of the blade.

The design of the blade according to the present invention can be applied to any type of common blade of the prior art and also to their combination of inner or outer part. Of course both final noise and final efficiency values are greatly conditioned by the type of blade selected to apply the invention. An optimization must follow, different case by case, depending also if low noise or better efficiency is preferred. The common, prior art blade which was selected to be modified according to the present is of the kind as depicted in FIG. 2*c*, which is consisting essentially of a profile with a trimmed flap on the trailing edge. However, blades as depicted in (FIG. 2*b* have been also briefly tested to have evidence that the invention can be really applied to any type of blades.

The reason why the type c blade has been preferred for the test program, was that there were several options as to the dimensions of the V angle and the locations of the points Vv, B and C relative positions to be tested and it was requiring a large number of different blades. This type of blade appeared ideal to be manufactured in a very fast and simple way. In fact, this blade can be made out of extruded or pultruded profile and to make a different executions it is only matter of cutting and drilling and joining in a different way. Actually this is a preferred embodiment for its simplicity. Other embodiments foresee to add on this blade prior art systems which are particularly effective on the invented design like winglets on tip or saw teeth on the trailing edge.

A further preferred embodiment foresees an adequate attachment to the hub, which has been identified as a rectangular shape attachment because laser, plasma, oxy cutting systems could be used to cut any type of shape in a metal sheet and then the optimized position of the blade with respect to the fan radius can be obtained at low cost.

Figure 9:
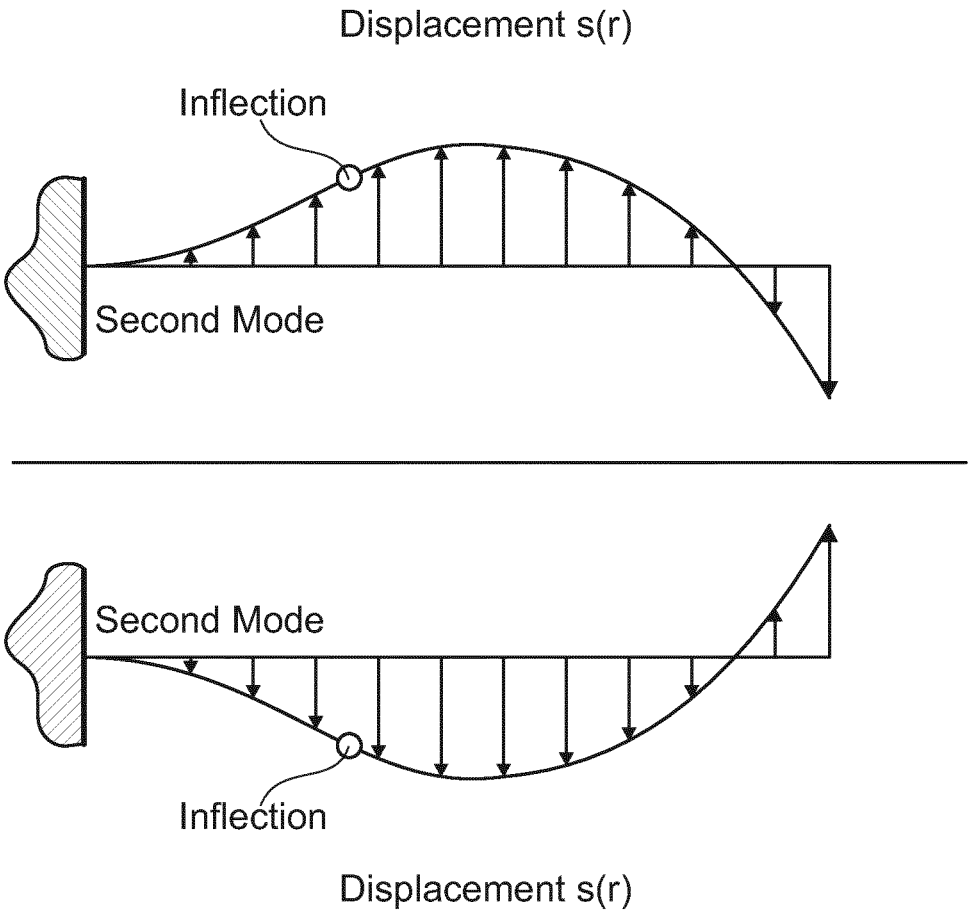
FIG. 9 schematically shows the second mode of vibration of the blade according to an embodiment of the present invention.

A second mode vibration attachment as sketched in the FIG. 9 would be ideal for this type of blade, not only because it is lowering the loads but also because if the bade is not too long this attachment could enter the blade for an extension that it would give the possibility to reach the outer profile part so that it could be directly fixed on it. However fixing the two blade parts together is very simple in this case and numerous solutions could be used.

Within the meaning of the present invention, the blade 1 can be provided both by joining together the inner portion 1*a* and the outer portion 1*b* (prepared in advance) or even by forming the blade 1, comprising inner portion 1*a* and outer portion 1*b* as a single one piece blade, casting aluminum, steel or plastic to get the shapes according the invention, for small and medium size blades. For large blades instead it could be used any of the fiberglass construction systems actually used for the common large blades.

Of course, this construction system could be also used for the small blades.

A combination of different embodiments for inner and outer part of blade could also could be a good solution.

The extraordinary results achieved by means of the blade according to the present invention can be fully understood when noise and aerodynamic efficiency are considered.

In the following, as anticipated, the blade according to the present invention (FIG. 6) will be compared with blades according to the prior art (FIGS. 7*a* and 7*b*).

As to the noise level, the following has to be considered.

Figure 8B:
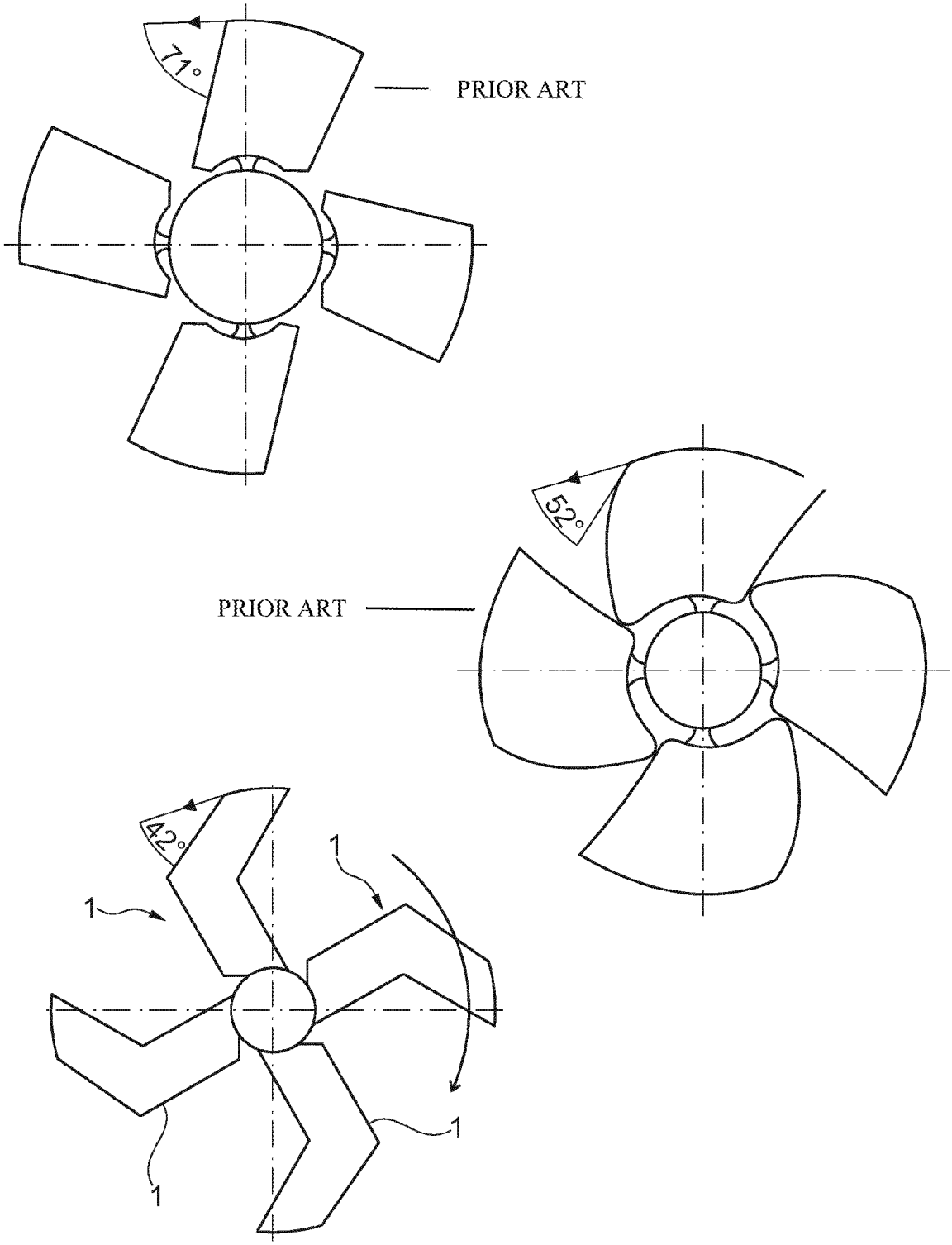
In FIG. 8*b* there are compared the angles at tip trailing edge and the air relative velocity of blades according to the prior art and an embodiment of the present invention, respectively.

The forward sweep angle that the leading edge is forming at the tip with the air relative velocity direction as indicated by the arrows (see also FIG. 8*a*), is comparable to that of the low noise fan of FIG. 6 and much larger than that of FIGS. 7*a* and 7*b*, taking the maximum advantage derived by the noise attenuation related to the forward swept leading edge blade technique;

The forward sweep angle that the trailing edge is forming at the tip with the air relative velocity direction (FIG. 8*b*) is smaller than that of any of the low noise fan shown in FIGS. 7*a* and 7*b*, taking the maximum advantage derived by the noise attenuation related to the forward swept trailing edge blade technique.

The leading edge extension is wider than that of FIGS. 7*a* and 7*b*, in a range from 1.05 to 1.46 times, desirably, though not necessarily, 1.2 times. Therefore larger than the prior art will be the noise benefit.

The trailing edge extension is much larger than prior art by a unique very large amount, in a range from 1.1 to 3 times, desirably, though not necessarily, 1.5 times. Therefore much larger will be the related noise benefit. Additionally the relevant extension of the trailing edge allows to utilize in a much more efficient way the several well-known techniques to reduce the sound emission to be applied on the trailing edge, for example a serrated system.

The average tip clearance on the tip will be greatly smaller because the chord is smaller and the noise originated by the tip vortices will be reduced.

The relatively small size of tip chord is allowing to still apply as a standard the tip winglets which, as it is well known, can further reduce the noise. The tip winglet cannot be applied on large chord blades because at high pitch angle has a negative effect.

With reference to the aerodynamic efficiency, the following has to be considered. The described geometry or design is realized stacking in blade span direction wing profile having very high aerodynamic efficiency.

The blade span is increased maintaining the same chord width, allowing to increase the ratio length/width and consequently, as well known from whom is skilled in the aerodynamics, the blade efficiency.

The blade can be not only twisted but also tapered from root to tip the get the best efficiency as a common fan of noise level 1. At the contrary the fan blades according to the prior art are tapered from tip to root decreasing the blade efficiency.

Furthermore, the blade airfoil sections are disposed in the optimal direction with respect to the incident air stream, optimizing the air circulation around the section itself, particularly on the outer part of the bade where the most part of the flow passes through.

The winglet at the tip will also improve the efficiency, allowing less backflow to pass. With reference to the manufacturing costs, the following should be considered.

The reduced chord width distribution all along the radial span makes the fan blade lighter than the known solutions, consequently the bending and axial loads at the radial sections are reduced, particularly at the root.

The reduced chord width, particularly at the outer part of the blade, contributes to reduce the inertial torsional moment at the root section.

The higher efficiency of the blade means lower drag force at the same lift, with a consequent reduction of shear loads at the radial sections, particularly at the root.

The load reduction all along the blade radial span and particularly at the root section allows to design reduced sections to resist to them with a significant reduction in material cost.

In the following, with reference to FIG. 12, a further embodiment of a blade according to the present invention will be described.

Figure 12:
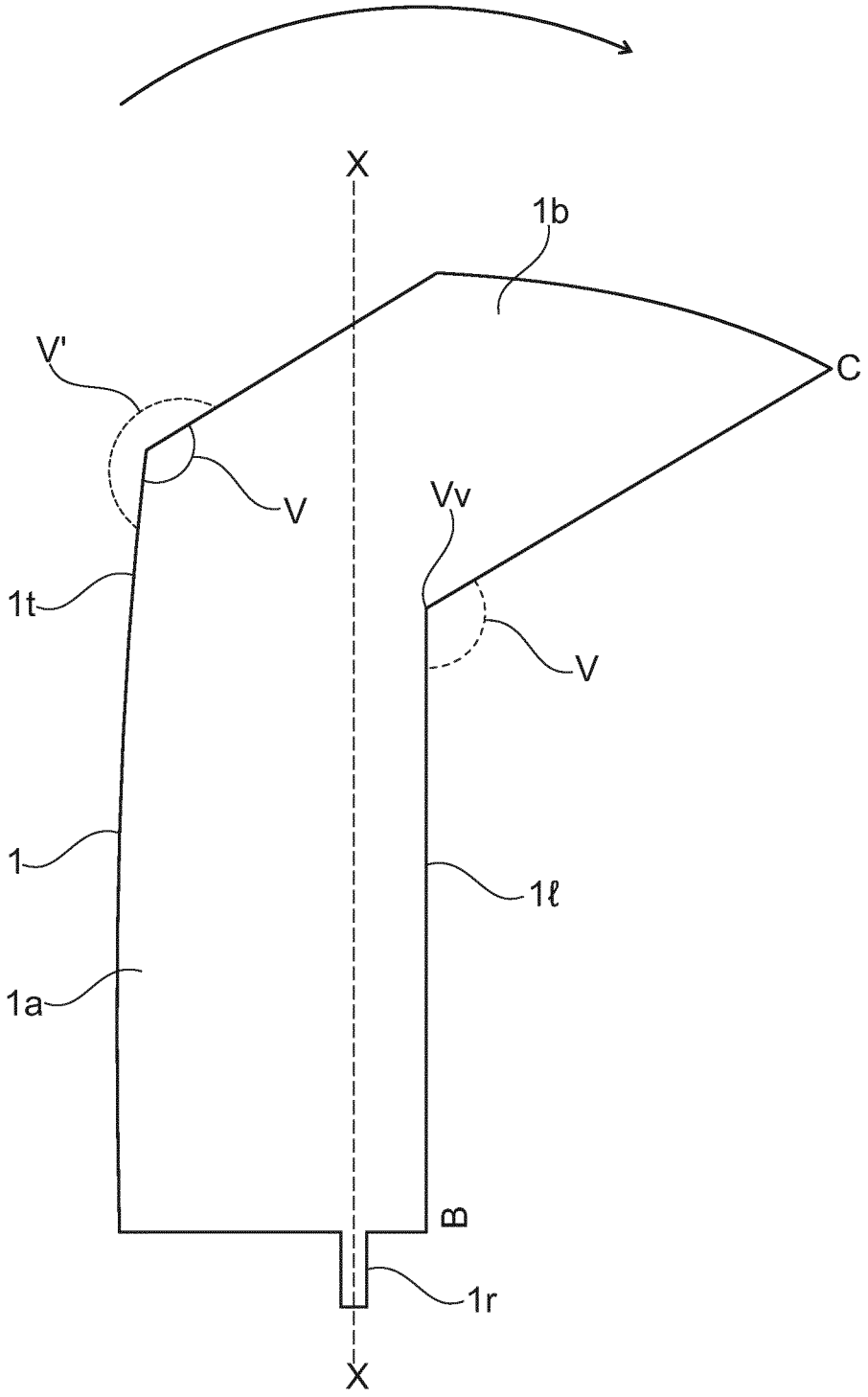
In FIG. 12 there is depicted a blade according to a further embodiment of the present invention.

In FIG. 12, the blade according to the embodiment of the present invention as depicted therein is still identified by the reference numeral 1. The blade 1 still comprises a root portion 1*r* provided for the purpose of fixing the blade 1 to an axial rotor (not depicted in FIG. 12); again, the blade may be fixed to the axial fan at different orientation angles (pitch angles) with respect to the axis X-X as identified by the dashed line in FIG. 12. The rotor is supposed to be rotated, during operation of the fan, in the clockwise direction as depicted by the arrow, the axis of rotation of the fan corresponding to the axis of rotation of the rotor. With respect to FIG. 12, the axis of rotation is perpendicular to plane of the figure; the smallest pitch angle is the angle at which the projection of the blade on a plane perpendicular to the axis of rotation occupies the largest area or surface. Pitch angles of larger amounts result in the projections of the blade on the plane perpendicular to the axis of rotation (also referred to, in the following, as the "plane of rotation) occupying corresponding smaller areas or surfaces. As depicted, with the blade 1 oriented at the smallest pitch angle, in particular at zero pitch angle, the projection of the blade on the rotation plane, is such that a V shape is formed along the span of the blade (see FIG. 12). In particular, the blade 1 comprises a first, inner, portion 1*a* close to the rotational axis (to the root portion 1*r*) and extending from the root portion 1*r*, along with a second, outer, portion 1*b*, and extending from the first portion 1*a*. With respect to the axis X-X, the first portion 1*a* extends along a first direction substantially parallel to the axis X-X, whilst, still with respect to the axis X-X, the second portion 1*b* extends along a second direction other than the first direction (forming an angle with the axis X-X).

Moreover, with respect to the direction of rotation of the blade 1 (identified by the arrow in FIG. 12), in the blade 1 two edges can still be identified, namely the leading edge 1*l* impinging against the air during rotation of the blade 1), and the trailing edge 1*t* (opposite to the leading edge 1I).

Still as depicted, the first portion 1*a* and the second portion 1*b* are oriented one with respect to the other so that an obtuse angle V (more than 90° and less than 180°) is still defined by the leading edge 1I, whilst a bigger angle (more than 180°) is defined by the trailing edge 1*t*.

Aa apparent, the main difference between the embodiment of FIG. 5 and the embodiment of FIG. 12 relates to the fact that, in the embodiment of FIG. 12, with reference to the axis X-X which, as depicted, crosses both the blade portion 1*a* and the blade portion 1*b*, the vertex Vv of the angle V defined by the leading edge 1*l* and the opposite tips (points B and C) of the leading edge 1*l* are located on the same side with respect to the axis X-X.

Moreover, a further difference with respect to the embodiment of FIG. 5 may relate to the length of the bade portions 1*a* and 1*b* which, in the embodiment of FIG. 12, have different lengths.

However, even in the embodiment of FIG. 12 the blade portions 1*a* and 1*b* may have substantially the same length. In the same way, as anticipated, the blade portions in the embodiment of FIG. 5 may have different lengths.

It has therefore been demonstrated, by means of the above description of the embodiments of the present invention depicted in the drawings that the present invention allows to overcome the drawbacks affecting the solutions according to the prior art.

Although the present invention has been clarified by means of the above description of the embodiment thereof as depicted in the drawings, the present invention is not limited to the embodiments as disclosed above and depicted in the drawings.

As an example, within the meaning of the present invention, the blade can be manufactured according to different methods among those known in the art, for instance extruding and/or pressing and/or forging one or both of the two blade portions and joining them by welding, screwing, gluing or the like.

Moreover, one or both of the blade portions may be hollow or not.

Finally, it is pointed out that even if the blade according to the present invention (to each embodiment thereof) has been disclosed as being particularly adapted to the used in combination with large diameter axial fans, the possible applications of the blade according to the present invention are not limited to large diameter axial fans but comprise fans of any size and/or diameter.

Moreover, the blade according to the present invention may be used in combination with fans provided for purposes other than cooling such as in fans of helicopters and/or airplanes or the like.

The scope of the present invention is rather defined by the appended claims.

The invention claimed is:

1. A low noise industrial axial fan, having a diameter more than 900 mm and adjustable pitch angle and comprising a blade, for propelling air from a low air pressure space to a high air pressure space, comprising a front edge and a rear edge, the front edge being leading edge of the blade facing a direction of rotation of the fan in an operative condition, and said rear edge being a trailing edge of the blade, said blade comprising a root portion by means of which the blade is fixed to a rotor of the fan, along with a first blade portion extending from said root portion and a second blade portion extending from said first portion, wherein a portion of the leading edge as defined by said first portion and a portion of said leading edge as defined by said second portion extend along different directions and define a first obtuse angle so that a projection of the blade on a rotation plane perpendicular to an axis of rotation is V-shaped wherein the first obtuse angle extends in the direction of rotation of the fan.

2. The axial fan according to claim 1, wherein the blade, the portion of the trailing edge as defined by said first portion and a portion of said trailing edge as defined by said second portion extend along different directions and define a second obtuse angle so that a projection of the blade on a rotation plane perpendicular to the axis of rotation is V-shaped.

3. The axial fan according to claim 1, wherein the root portion is shaped so as to define a pitch adjustment axis X-X, and in that with reference to said pitch adjustment axis X-X, a vertex of the angle as defined by said portion of the leading edge as defined by said first portion and said portion of said leading edge as defined by said second portion lies on one side whilst opposite tips of said leading edge lie on another side.

4. The axial fan according to claim 3, wherein at least one of opposite tips of the leading edge is oriented towards the low air pressure space.

5. The axial fan according to claim 1, the root portion is shaped so as to define a pitch adjustment axis X-X, and in that with reference to said pitch adjustment axis X-X, a vertex of the angle as defined by said portion of the leading edge as defined by said first portion and said portion of said leading edge as defined by said second portion lies on one side along with opposite tips of said leading edge.

6. The axial fan according to claim 1, in which said first obtuse angle is comprised between 90° and 170°.

7. The axial fan according to claim 6, in which said first obtuse angle is comprised between 100° and 120°.

8. The axial fan according to claim 1, wherein at the portion of a blade where said first portion and said second portion joint, a dihedral angle of 195° between suction surfaces of the first portion and the second portion in a vertical plane.

9. The axial fan according to claim 1, wherein, in the blade, a first, inner portion is obtained starting by a rectilinear blade by rotating a part of the blade profile backwards counterclockwise, around a vertical axis passing where a pitch adjustment axis is crossing a blade root section, and a second, outer portion is obtained by rotating a part of a blade profile backwards clockwise around the vertical axis passing where the pitch adjustment axis is crossing a blade tip section.

10. The axial, fan according to claim 1, wherein the blade or an airfoil part of is a one-piece blade, made of casting aluminum or steel or plastic or any other suitable material.

11. The axial fan according to claim 1, wherein said first blade portion and said second blade portion form on said trailing edge a rounded angle.

12. The axial fan according to claim 1, wherein said first blade portion and said second blade portion have slightly curved leading edges.

13. The axial fan according to claim 1, wherein said first blade portion and said second blade portion have slightly curved trailing edges.

14. The axial fan according to claim 1, wherein said blade comprises a winglet on its tip.

* * * * *